US005828275A

United States Patent [19]

Kita et al.

[11] Patent Number: 5,828,275

[45] Date of Patent: Oct. 27, 1998

[54] DIELECTRIC FILTER INCLUDING AN ADJUSTED INNER ELECTRODE AND A COUPLING ELECTRODE BEING LEVEL WITH AN OPEN END OF A MOLDED MEMBER

[75] Inventors: Masaki Kita, Kyoto; Makoto Fujikawa, Ikoma; Takashi Fujino, Izumi; Hideyuki Miyake, Matsubara, all of Japan

[73] Assignee: Matsushita Electric Industrial Co., Ltd., Kadoma, Japan

[21] Appl. No.: 603,457

[22] Filed: Feb. 20, 1996

[51] Int. Cl.[6] ..... H01P 1/205

[52] U.S. Cl. ..... 333/207; 333/223

[58] Field of Search ..... 333/202, 206, 333/207, 222, 223

[56] References Cited

U.S. PATENT DOCUMENTS

| | | | |
|---|---|---|---|
| 4,431,977 | 2/1984 | Sokola et al. | 333/206 |
| 4,673,902 | 6/1987 | Takeda et al. | 333/206 X |
| 5,146,193 | 9/1992 | Sokola | 333/206 |
| 5,175,520 | 12/1992 | Inoue | 333/223 X |
| 5,436,602 | 7/1995 | McVeety et al. | 333/207 X |
| 5,499,004 | 3/1996 | Noguchi et al. | 333/206 X |
| 5,563,561 | 10/1996 | Ishihara et al. | 333/206 |
| 5,629,656 | 5/1997 | Tada et al. | 333/206 X |

FOREIGN PATENT DOCUMENTS

| | | | |
|---|---|---|---|
| 0636897 | 1/1995 | European Pat. Off. | 333/206 |
| 6-112704 | 4/1989 | Japan | 333/206 |
| 6-303006 | 10/1994 | Japan | 333/206 |

*Primary Examiner*—Seungsook Ham
*Attorney, Agent, or Firm*—Renner, Otto, Boisselle & Sklar, P.L.L.

[57] ABSTRACT

A dielectric filter is made of a dielectric material and includes a molded member of a pillar shape which has a hole formed from the top surface thereof toward the inside, an inner electrode formed so as to cover the inner circumferential surface of the hole; an outer electrode provided so as to cover the outer surface of the molded member except a prescribed region, and a coupling electrode provided at least in a portion of the prescribed region. An electrode area of a region of the inner electrode which faces against the coupling electrode is adjusted, thereby adjusting the coupling capacitance which is formed between the inner electrode and the coupling electrode.

18 Claims, 5 Drawing Sheets

DIELECTRIC FILTER INCLUDING AN ADJUSTED INNER ELECTRODE AND A COUPLING ELECTRODE BEING LEVEL WITH AN OPEN END OF A MOLDED MEMBER

BACKGROUND OF THE INVENTION

1. Field of the Invention

The present invention relates to a dielectric filter to be used in a communication device or the like, and to a method of adjusting the bandwidth thereof.

2. Description of the Related Art

FIG. 8 is an isometric view illustrating a structure of a typical conventional dielectric filter 50.

In the dielectric filter 50, a molded member 1 of substantially rectangular shape which is made of a dielectric material is provided with two through holes 2 which are formed from the top surface to the bottom surface. Input/output electrodes 4 are provided on a pair of side surfaces of the molded member 1 which are facing against one another, respectively. The two input/output electrodes 4 are provided so as to face against each other. An outer electrode le is provided over the outer circumferential surface of the molded member 1 except regions where the input/output electrodes 4 are provided and the vicinities thereof. Furthermore, an inner electrode 2*e* is provided on the inner circumferential surface of the respective through holes 2.

In the molded member 1, a slit 3 for adjusting the bandwidth is provided at a position between the through holes 2 from the top surface side. By setting an appropriate depth of the slit 3, a degree of magnetic coupling between the through holes 2 is set, thereby determining a bandwidth of the dielectric filter 50. Specifically, before the molded member 1 is molded, the depth of the slit 3 which realizes a desired bandwidth is determined as a calculated value. The slit 3 having the depth thus determined by the calculation Is then formed when the molded member 1 is molded. A desired bandwidth of the dielectric filter 50 is thereby realized.

However, in the conventional dielectric filter 50 which is designed and formed as described above, the depth of the slit 3 which determines the bandwidth has already been determined at the time of molding the molded member 1, or more accurately, at the time of designing the dielectric filter 50. Since it is difficult to adjust the depth of the slit 3 once the molded member 1 has been molded, the adjustment of the bandwidth of the dielectric filter 50 cannot be performed after the production thereof.

SUMMARY OF THE INVENTION

According to one aspect of the invention, a dielectric filter includes: a molded member of a pillar shape which is made of a dielectric material and has a hole formed from a first end surface thereof toward the inside; an inner electrode formed so as to cover the inner circumferential surface of said hole; an outer electrode provided so as to cover a portion of the outer surface of said molded member except a prescribed region; and a coupling electrode provided at least on a portion of said prescribed region. An electrode area of a region of said inner electrode which faces against said coupling electrode is adjusted, thereby adjusting the coupling capacitance which is formed between said inner electrode and said coupling electrode.

According to another aspect of the invention, a dielectric filter including a plurality of dielectric filter components is provided. Each of the plurality of said dielectric filter components includes: a molded member of a pillar shape which is made of a dielectric material and has a hole formed from a first end surface thereof toward the inside; an inner electrode formed so as to cover the inner circumferential surface of said hole; an outer electrode provided so as to cover a portion of the outer surface of said molded member except a prescribed region; and a coupling electrode provided at least on a portion of said prescribed region. The coupling electrodes of said plurality of dielectric filter components are electrically connected with each other, and in at least one of the plurality of said dielectric filter components, an electrode area of a region of said inner electrode which faces against said coupling electrode is adjusted, thereby adjusting the coupling capacitance which is formed between said inner electrode and said coupling electrode.

According to still another aspect of the invention, a dielectric filter includes; a molded member of a pillar shape which is made of a dielectric material and has a hole formed from a first end surface thereof toward the inside; an inner electrode formed so as to cover a portion of the inner circumferential surface of said hole except a selected region; an outer electrode provided so as to cover a portion of the outer surface of said molded member except a prescribed region; and a coupling electrode provided at least on a portion of said prescribed region. The said selected region of said inner electrode is located so as to face against said coupling electrode, thereby adjusting an electrode area of said inner electrode which faces against said coupling electrode, and adjusting the coupling capacitance formed between said inner electrode and said coupling electrode.

According to still another aspect of the invention, a dielectric filter including a plurality of dielectric filter components is provided. Each of the plurality of said dielectric filter components includes: a molded member of a pillar shape which is made of a dielectric material and has a hole formed from a first end surface thereof toward the inside; an inner electrode formed so as to cover a portion of the inner circumferential surface of said hole except a selected region; an outer electrode provided so as to cover a portion of the outer surface of said molded member except a prescribed region; and a coupling electrode provided at least on a portion of said prescribed region. The coupling electrodes of said plurality of dielectric filter components are electrically connected with each other; and in at least one of the plurality of said dielectric filter components, said selected region of said inner electrode is located so as to face against said coupling electrode, thereby adjusting an electrode area of said inner electrode which faces against said coupling electrode, and adjusting the coupling capacitance formed between said inner electrode and said coupling electrode.

According to still another aspect of the invention, a method of adjusting a bandwidth of a dielectric filter is provided. The dielectric filter is made of a dielectric material and includes a molded member of a pillar shape which has a hole formed from a first end surface thereof toward the inside, an inner electrode formed so as to cover the inner circumferential surface of said hole, an outer electrode provided so as to cover the outer surface of said molded member except a prescribed region, and a coupling electrode provided in at least on a portion of said prescribed region. The method includes the step of adjusting the electrode area by trimming a prescribed region of said inner electrode which faces against said coupling electrode.

According to still another aspect of the invention, a method of adjusting a bandwidth of a dielectric filter including a plurality of dielectric filter components is provided. Each of the plurality of said dielectric filter components includes a molded member which is made of a dielectric material and has a hole formed from a first end surface thereof toward the inside, an inner electrode formed so as to cover the inner circumferential surface of said hole, an outer electrode provided so as to cover a portion of the outer surface of said molded member except a prescribed region, and a coupling electrode provided at least on a portion of said prescribed region, and said coupling electrodes of the plurality of said dielectric resonators are electrically connected with each other. The method includes the step of in at least one of the plurality of said dielectric filter components, adjusting an electrode area by trimming a prescribed region of said inner electrode which faces against said coupling electrode.

Thus, the invention described herein makes possible the advantages of (1) providing a dielectric filter having a structure which allows the adjustment of a bandwidth to be performed even after the production thereof, and (2) providing a method of adjusting a bandwidth of a dielectric filter which can easily be performed even after the production thereof.

These and other advantages of the present invention will become apparent to those skilled in the art upon reading and understanding the following detailed description with reference to the accompanying figures.

DESCRIPTION OF THE PREFERRED EMBODIMENTS

Example 1

Figure 1:
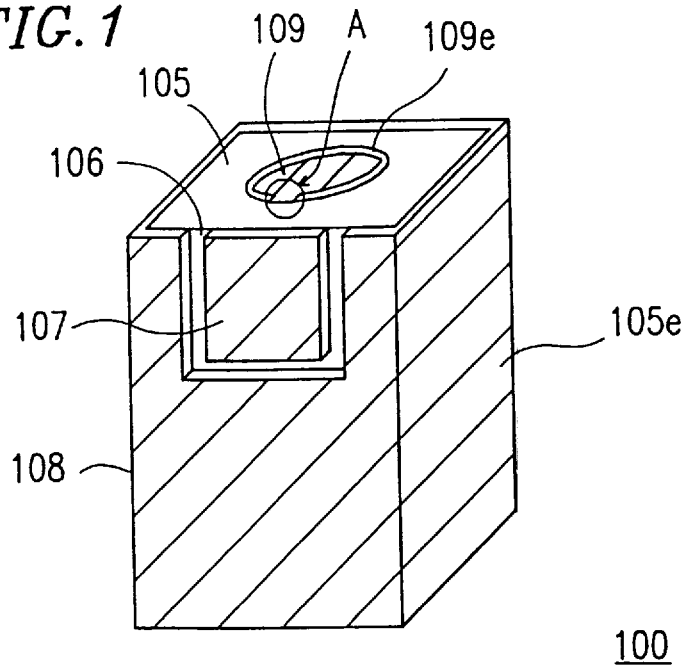
FIG. 1 is an isometric view illustrating a structure of a dielectric filter in a first example of the present invention.

FIG. 1 is an isometric view illustrating a structure of a dielectric filter 100 in the first example of the present invention.

In the dielectric filter 100, a molded member 105 of a square pillar shape which is made of a dielectric material is provided with a through hole 109 which is formed from the top surface to the bottom surface. This molded member 105 functions as a dielectric resonator for the dielectric filter 100.

An outer electrode lose is provided over the outer surface of the molded member 105 except a part of the side surface and the top surface thereof. Furthermore, an inner electrode loge is provided on the inner circumferential surface of the through hole 109. The outer electrode 105*e* and the inner electrode 109*e* are electrically connected with each other at the bottom surface of the molded member 105. Accordingly, the top surface of the molded member 105 functions as an open end, and the bottom surface as a shorted end.

The designations "top surface" and "bottom surface" as used herein with respect to the molded member 105 were conveniently made for the purpose of description and, can be used interchangeably. For instance, the structure is possible in which the top surface functions as the shorted end and the bottom surface functions as the open end.

The outer electrode 105*e* is not provided on a region 106 of the outer circumferential surface of the molded member 105. Instead, a coupling electrode 107 is provided on the region 106. This coupling electrode 107 makes a capacitive coupling with the inner electrode 109*e*.

A single-stage band-stop dielectric filter 100 of a structure described above is thus obtained.

Figure 2:
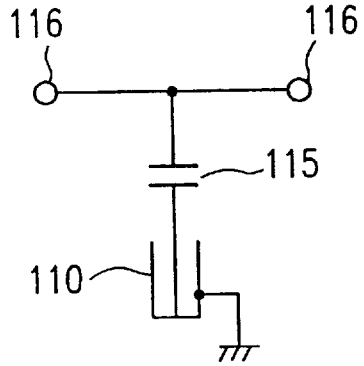
FIG. 2 is a circuit diagram illustrating an equivalent electrical circuit for the dielectric filter illustrated in FIG. 1.

FIG. 2 is an equivalent circuit for the dielectric filter 100.

One end of the coupling capacitance 115 formed between the inner electrode 109*e* and the coupling electrode 107 is connected between the input/output terminals 116 which correspond to the coupling electrode 107. A resonating section 110 of the dielectric resonator is further connected to the coupling capacitance 115.

Figure 3:
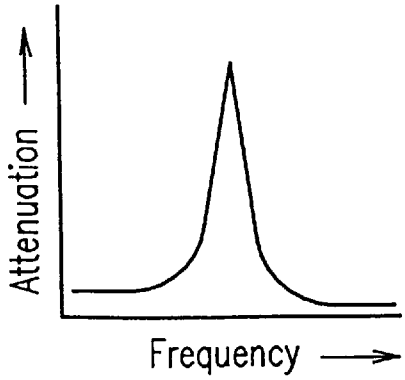
FIG. 3 is a graph illustrating dynamic characteristics of the dielectric filter illustrated in FIG. 1.

FIG. 3 is a graph schematically illustrating the dynamic characteristics of the dielectric filter 100. The graph illustrates a relationship between frequencies of the input signals which is given to the dielectric filter 100 and the attenuation thereof. As apparent from FIG. 3, the dielectric filter 100 operates as a band-stop filter which does not allow an Input signal having A frequency within a prescribed range (band) to pass.

Figure 9A:
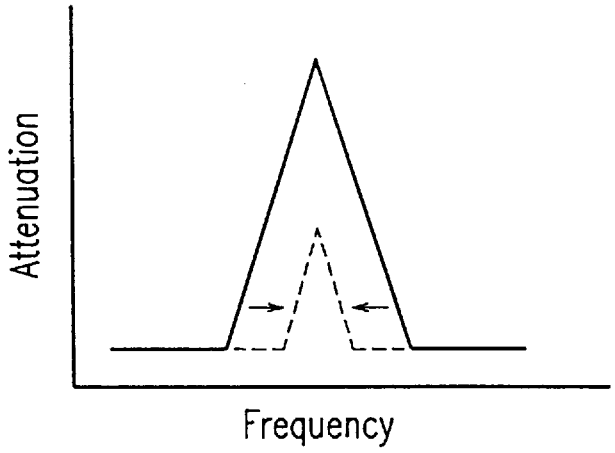
FIG. 9A is a diagram schematically illustrating the adjustment of a bandwidth of a band-stop filter in accordance with the present invention.

In the above structure described with reference to FIG. 1, a portion of the inner electrode 109*e* which is facing against the coupling electrode 107 is trimmed and a part thereof is removed to alter the area thereof. Thus, the coupling capacitance between the inner electrode 109*e* and the coupling electrode 107 changes. Accordingly, the bandwidth of the dielectric filter 100 can be changed to adjust the band characteristics Specifically, by trimming the portion of the inner electrode 109*e* which is facing against the coupling electrode 107 and thereby reducing the area thereof, the resultant coupling capacitance is reduced. As a result, attenuation in the stop-band is reduced and the bandwidth is narrowed, which are shown in FIG. 9A as transition from a solid line to a dashed line.

In FIG. 1, a portion of the inner electrode 109*e* which has been removed is designated by "A".

The trimming of the inner electrode 109*e* can be conducted by a method such as sand blasting, laser trimming, or trimming with a router. Typically, it is conducted by trimming with a router.

As described above, in the dielectric filter 100, the electrode area can be adjusted by trimming a portion of the inner electrode 109*e*, thereby adjusting the coupling capacitance and, consequently, the dynamic characteristic thereof.

The molded member 105 can be of cylindrical shape. Moreover, instead of providing the through hole 109, a hole which does not penetrate through but is formed from the top surface of the molded member 105 to a position close to the bottom surface thereof can be provided.

The molded member 105 is made of a dielectric material such as a barium titanate type material or a strontium titanate type material. Typically, it is made of a barium titanate type material. The outer electrode 105*e*, the inner electrode 109*e*, and the coupling electrode 107 are made of a material such as silver or copper. Typically, they are made of silver.

Although, in the example shown in FIG. 1, the coupling electrode 107 is provided such that the edge thereof is level with the top surface (open end) of the molded member 105 where the outer electrode 105*e* is not provided, the location of forming the coupling electrode 107 is not limited as such. For example, the coupling electrode 107 can be formed around the center of the side surface of the molded member 105. Nevertheless, when the coupling electrode 107 is provided at the location described above, a portion of the inner electrode 109*e* which faces against the coupling electrode 107 and is to be subjected to the trimming also comes to be located in the vicinity of the top surface (open end) of the molded member 105. Therefore, the trimming can easily be performed and the adjustment of the bandwidth can easily be realized.

Example 2

Figure 4:
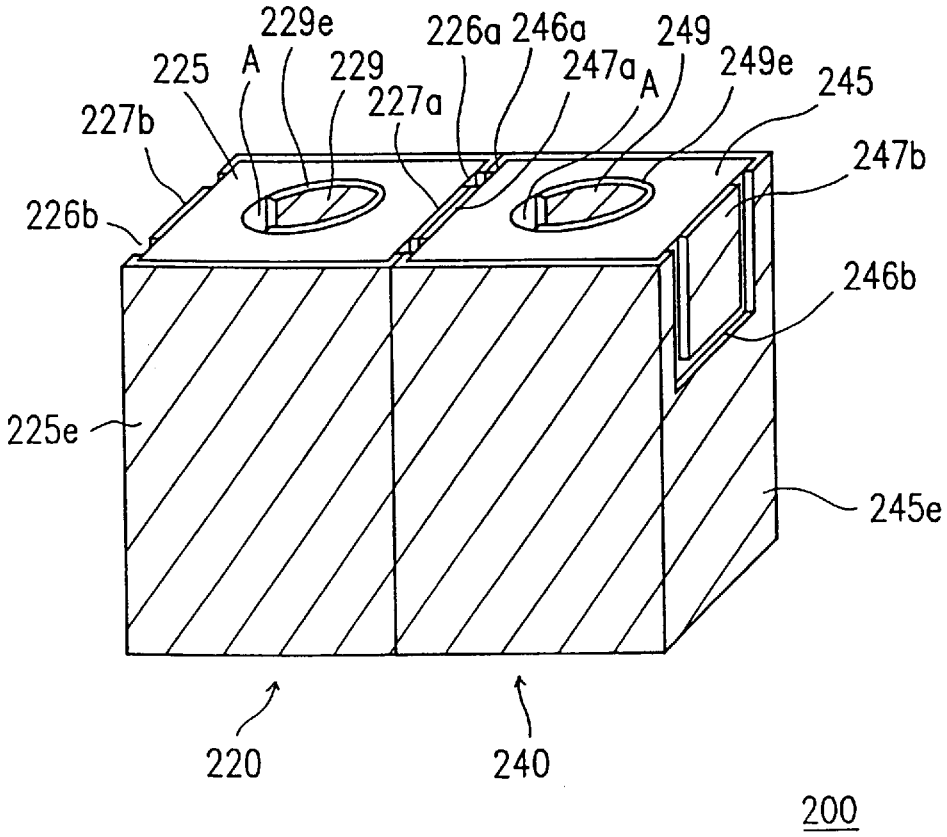
FIG. 4 is an isometric view illustrating a structure of a dielectric filter in a second example of the present invention.

FIG. 4 is an isometric view illustrating a structure of a dielectric filter 200 in the second example of the present invention. The dielectric filter 200 is constituted of two of dielectric resonators (dielectric filter components) 220 and 240 combined together.

Figure 5:
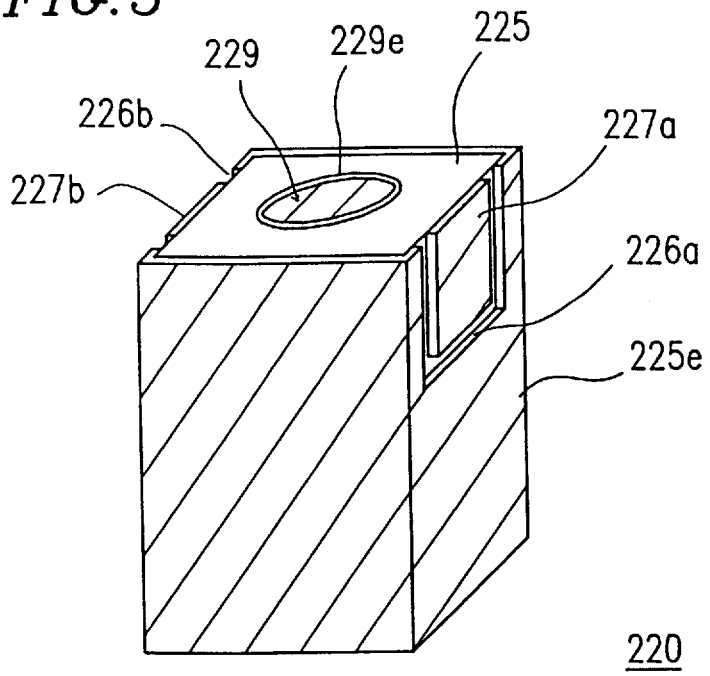
FIG. 5 is an isometric view illustrating a structure of a dielectric resonator (a dielectric filter component) included in the dielectric filter illustrated in FIG. 4.

FIG. 5 is an isometric view illustrating a structure of the dielectric resonator 220. Although the structure of the dielectric resonator 220 will be described below as an example, the other dielectric resonator 240 also has a similar structure. Corresponding constituent elements of the dielectric resonators 220 and 240 are designated by the similar reference numerals. The detailed description regarding the dielectric resonator 240 is omitted here.

In the dielectric filter 220, a molded member 225 of a square pillar shape which is made of a dielectric material is provided with a through hole 229 which is formed from the top surface to the bottom surface.

An outer electrode 225*e* is provided over the outer surface of the molded member 225 except a part of the side surface and the top surface thereof. Furthermore, an Inner electrode 229*e* is provided on the inner circumferential surface of the through hole 229. The outer electrode 225*e* and the inner electrode 229*e* are electrically connected with each other at the bottom surface of the molded member 225. Accordingly, the top surface of the molded member 225 functions as an open end, and the bottom surface as a shorted end.

The designations "top surface" and "bottom surface" as used herein with respect to the molded members 225 and 245 were conveniently made for the purpose of the description, and can be used interchangeably. For instance, the structure is possible in which the top surface functions as the shorted end and the bottom surface functions as the open and.

The outer electrode 225*e* is not provided on two regions 226*a* and 226*b* of the outer circumferential surface of the molded member 225. Instead, coupling electrodes 227*a* and 227*b* are provided on the regions 226*a* and 226*b*, respectively. The coupling electrodes 227*a* and 227*b* make capacitive couplings with the inner electrode 229*e*. The coupling electrodes 227*a* and 227*b* are provided such that the upper edges thereof are level with the top surface (open end) of the molded member 225.

As will be described later, also in the dielectric resonator 220, portions of the inner electrode 229*e* which face the coupling electrodes are trimmed and parts thereof are removed. However, the illustration thereof is omitted in FIG. 5.

Furthermore, in the dielectric filter 200 illustrated in FIG. 4 which includes the two dielectric resonators 220 and 240 combined together, the coupling electrode 227*a* of the dielectric resonator 220 and the coupling electrode 247*a* of the dielectric resonator 240 are in mutual contact and electrically connected. As a result, the dielectric resonators 220 and 240 are coupled via the coupling electrodes 227*a* and 247*a*.

Furthermore, the outer electrodes 225*e* and 245*e* of the dielectric resonators 220 and 240, respectively, are mutually electrically connected. Moreover, the coupling electrodes 227*b* and 247*b* make capacitive coupling with the inner electrode 229*e* and 249*e*, respectively.

A double-stage band-pass dielectric filter 200 which has two coupling electrodes 227*b* and 247*b* as input/output electrodes of a structure described above is thus obtained.

Figure 6A:
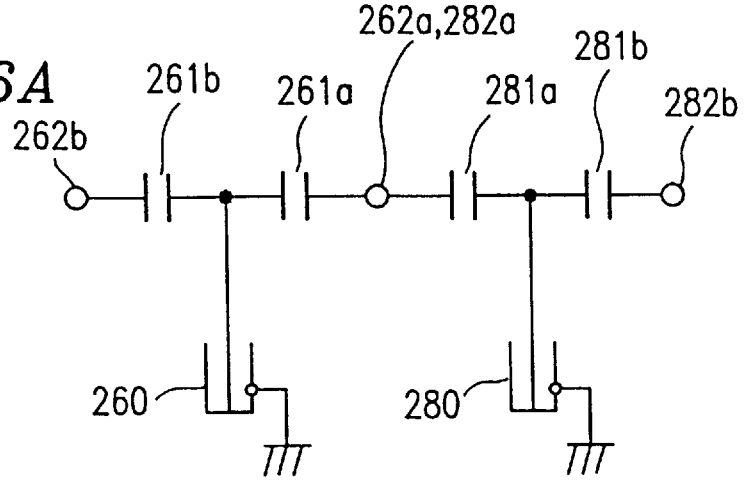
FIG. 6A is a circuit diagram illustrating an equivalent electrical circuit for the dielectric filter illustrated in FIG. 4.
Figure 6B:
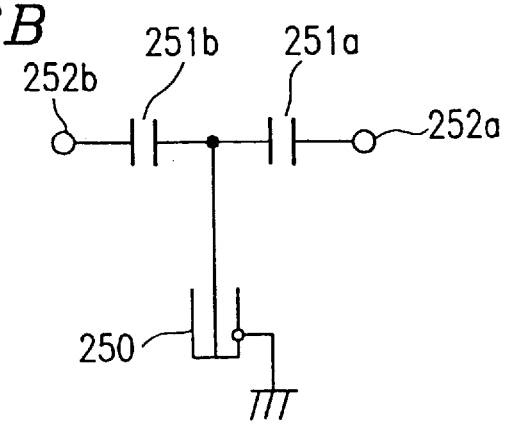
FIG. 6B is a circuit diagram illustrating an equivalent electrical circuit of the dielectric resonator illustrated in FIG. 5.

FIG. 6A is an equivalent electrical circuit for the dielectric filter 200. FIG. 6B is an equivalent electrical circuit for the dielectric resonators 220 and 240 which are included in the dielectric filter 200.

The circuit in FIG. 6B is essentially equal to the equivalent circuit of the dielectric filter 220 illustrated in FIG. 5 of the second example. That is, taking the dielectric resonator 220 as an example, the coupling capacitance (input/output capacitance) 251*a*, which is formed between the inner electrode 229*e* and the coupling electrode 227*a* shown in FIG. 5, and the coupling capacitance (input/output capacitance) 251*b*, which is formed between the inner electrode 229*e* and the coupling electrode 227*b* shown in FIG. 5, are connected between the input/output terminals 252*a* and 252*b* which correspond to the coupling electrodes 227*a* and 227*b*, respectively. One end of the resonating section 250 of the dielectric resonator 220 is further connected between the coupling capacitances 251*a* and 251*b*.

An equivalent circuit for the dielectric filter 200 as a whole as illustrated in FIG. 6A is described as follows. The coupling capacitance (input/output capacitance) 261*b* between the coupling electrode 227*b* and the inner electrode 229*e*, the coupling capacitance (interstage capacitance) 261*a* between the inner electrode 229*e* and the coupling electrode 227*a*, the coupling capacitance (interstage capacitance) 281*a* between the coupling electrode 247*a* and the inner electrode 249*e*, and the coupling capacitance (input/output capacitance) 281*b* between the inner electrode 249*e* and the coupling electrode 247*b* are successively connected in this order between the input/output terminals 262*b* and 282*b*. The input/output terminals 262*b* and 282*b* correspond to the coupling electrodes 227*b* and 247*b*, respectively. The coupling capacitance 261*b* is connected to the input/output terminal 262*b*, and the coupling capacitance 281*b* is connected to the input/output terminal 282*b*. One end of the resonating section 260 of the dielectric resonator 220 is connected between the coupling capacitances 261*a* and 261*b*, and one end of the resonating section 280 of the dielectric resonator 240 is connected between the coupling capacitances 281*a* and 281*b*. The terminal 262*a* (282*a*) which is placed between the coupling capacitances 261*a* and 281*a* in the equivalent circuit of FIG. 6A corresponds to the coupling electrodes 227*a* and 247*a* which are in mutual contact and electrically connected in the structure illustrated in FIG. 4.

Figure 7:
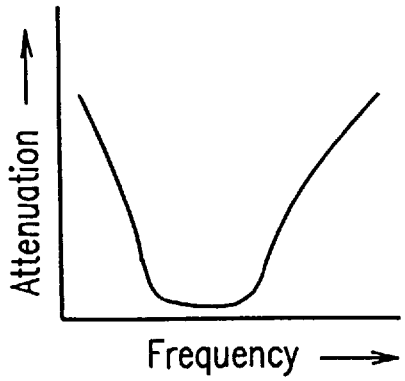
FIG. 7 is a graph illustrating dynamic characteristics of the dielectric filter illustrated in FIG. 4.
Figure 8:
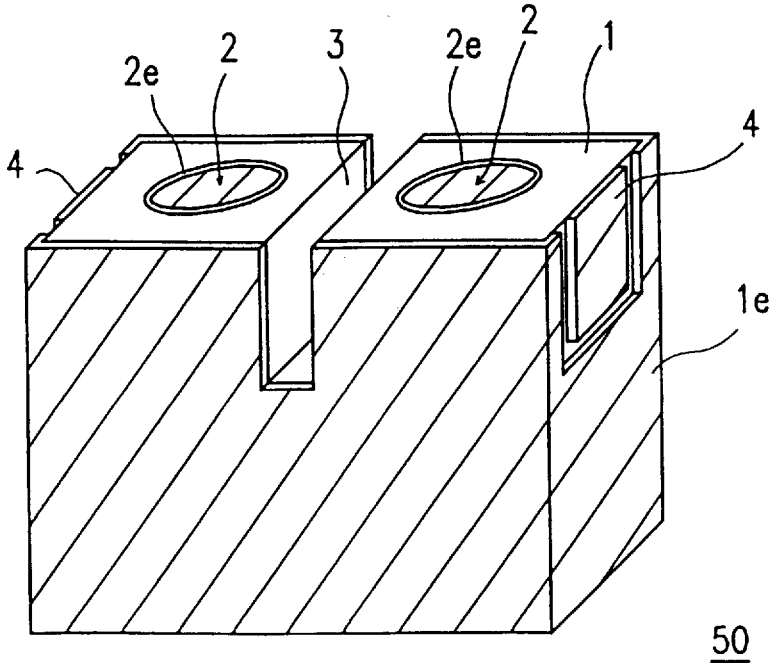
FIG. 8 PRIOR ART
FIG. 8 is an isometric view illustrating an example of the structure of a conventional dielectric filter.

FIG. 7 is a graph schematically illustrating the dynamic characteristics of the dielectric filter 200. The graph illustrates a relationship between frequencies of the input signal which is given to the dielectric filter 200 and the attenuation thereof. As apparent from FIG. 7, the dielectric filter 200 operates as a band-pass filter which allows only an Input signal having a frequency within a prescribed range (band) to pass.

In the structure of the dielectric filter 200 as above, portions of the inner electrodes 229*e* and 249*e* which are facing against the coupling electrodes are trimmed and parts thereof are removed to alter the areas thereof. Thus, the coupling capacitances between the inner electrodes 229*e* and 249*e* and the coupling electrodes change. Accordingly, the bandwidth of the dielectric filter 200 can be changed to adjust the band charecteristics.

Figure 9B:
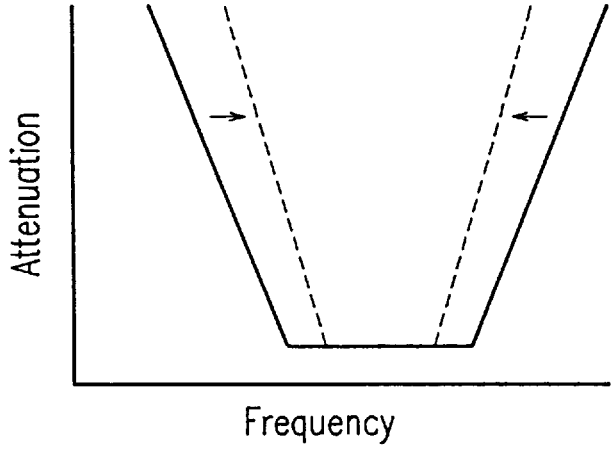
FIG. 9B is a diagram schematically illustrating the adjustment of a bandwidth of a band-pass filter in accordance with the present invention.

Specifically, by trimming the portions of the respective inner electrodes 229*e* and 249*e* which are facing against the coupling electrodes and thereby reducing the area thereof, the resultant coupling capacitances are reduced. Thus, by reducing the coupling capacitance while balancing the input/output capacitance and the interstage capacitance, the bandwidth is narrowed, which is illustrated in FIG. 9B as transition from a solid line to a dashed line.

In FIG. 4, portions of the inner electrodes 229*e* and 249*e* which have been removed are designated by "A".

In the example of FIG. 4, a region of the inner electrode 229*e* of the dielectric resonator 220 which faces against the coupling electrode 227*b* and a region of the inner electrode 249*e* of the dielectric resonator 240 which faces against the coupling electrode 247*a* are trimmed and parts thereof are removed respectively. However, the region to be subjected to trimming is not limited to be set as such.

For instance, a region of the inner electrode 229*e* of the dielectric resonator 220 which faces against the coupling electrode 227*b* and a region of the inner electrode 249*e* of the dielectric resonator 240 which faces against the coupling electrode 247*a* can be trimmed and parts thereof can be removed respectively. Alternatively, only one region of one of the dielectric resonators, for example, only a region of the inner electrode 229*e* of the dielectric resonator 220 which faces against the coupling electrode 227*b* can be trimmed. Furthermore, two regions of the inner electrode 229*e* of the dielectric resonator 220 which face against the coupling electrodes 227*a* and 227*b*, respectively, and two regions of the inner electrode 249*e* of the dielectric resonator 240 which face against the coupling electrodes 247*a* and 247*b*, respectively, can be trimmed and parts thereof can be removed respectively.

In any case, regions to be subjected for the trimming or the size of the region to be removed (the size of an electrode area to be obtained) is set in accordance with the dynamic characteristics (band characteristics) of the dielectric filter to be realized.

The trimming of the inner electrodes 229*e* and 249*e* can be conducted by a method such as sand blasting, laser trimming, or trimming with a router. Typically, it is conducted by trimming with a router.

As described above, in the dielectric filter 200, the electrode area can be adjusted by trimming portions of the inner electrodes 229*e* and 249*e*, thereby adjusting the coupling capacitance and, consequently, the dynamic characteristic thereof.

The molded members 225 and 245 can be of a cylindrical shape. Moreover, instead of providing the through holes 229 and 249, holes which do not penetrate through but are formed from the top surfaces of the molded members 225 and 245 to positions close to the bottom surfaces thereof can be provided.

The molded members 225 and 245 are made of a dielectric material such as a barium titanate type material or a strontium titanate type material. Typically, they are made of a barium titanate type material. The outer electrodes 225*e* and 245*e*, the inner electrodes 229*e* and 249*e*, and the coupling electrodes 227*a*, 227*b*, 247*a*, and 247*b* are made of a material such as silver or copper. Typically, they are made of silver.

In the example shown in FIG. 4, the coupling electrodes 227*a*, 227*b*, 247*a*, and 247*b* are provided such that the edges thereof are level with the top surfaces (open ends) of the molded members 225 and 245 where the outer electrodes 225*e* and 245*e* are not provided. However, the location of forming each of the coupling electrodes is not limited as such, but, for example, they can be formed around the center of the side surface of the molded members 225 and 245. Nevertheless, when the coupling electrodes are provided at the locations described above, portions of the inner electrodes 229*e* and 249*e* which face against the coupling electrodes and are to be subjected to the trimming also come to be located in the vicinity of the top surfaces (open ends) of the molded members 225 and 245. Therefore, the trimming can easily be performed and the adjustment of the bandwidth can easily be realized.

Moreover, instead of having the two dielectric resonators 220 and 240 in contact, they can be disposed on an appropriate substrate, realizing the structure that the wiring on the substrate makes the connection thereof.

Although, in the above description, the dielectric filter 200 is constituted of the two dielectric resonators 220 and 240 coupled together, the dielectric resonators 220 and 240 can be used alone to constitute the dielectric filter. The structure of the dielectric filter obtainable in this case is equivalent to that of the dielectric filter 100 described in the first example which is further provided with another coupling electrode such that the two coupling electrodes are disposed on a couple of side surfaces, which face to each other, of the molded member, each coupling electrode being coupled with the inner electrode.

As described above, in the dielectric filter of the present invention, an outer electrode is provided on a portion of the outer circumferential surface of the molded member. A through hole is provided from the top surface toward the bottom surface of the molded member, and an inner electrode is provided on the inner circumferential surface of the through hole. In doing so, a region where no outer electrode is provided is set up in a portion of the outer circumferential surface of the molded member, and a coupling electrode instead of the outer electrode is provided in this region. On the other hand, regions of the inner electrode which face against the coupling electrode serve as the adjustment region for the coupling capacitance.

In the above structure, the capacitance component (coupling capacitance) which is formed between the coupling electrode and the inner electrode can be adjusted by trimming a portion of the inner electrode which is included in the "coupling capacitance adjustment region" and removing a part thereof, thereby changing the area thereof. The bandwidth of the dielectric filter is then adjusted through the adjustment of the coupling capacitance. As a result, the adjustment of the bandwidth of the dielectric filter can be performed even after the production thereof.

Instead of a through hole, a hole which runs from the top surface toward the inside but does not penetrate throughout can be provided to the molded member, and the inner electrode can be provided on the inner surface. A similar effect can also be obtained in this case.

Furthermore, when the coupling electrode is provided such that the edge thereof is level with the top surface (open end) of the molded member where the outer electrode is not provided, a portion of the inner electrode which faces against the coupling electrode and is subjected to the trimming also comes to be located in the vicinity of the top surface (open end) of the molded member. Therefore, the trimming can easily be performed, and the bandwidth adjustment can easily be realized.

Furthermore, it is possible to appropriately combine a plurality of dielectric filter components (dielectric resonators) to realize a variety of dynamic characteristics.

In the dielectric filter of the present invention as described in the aforementioned examples, a portion of the inner electrode which is facing to the coupling electrode is subject to trimming and reducing the area thereof, thereby reducing the resultant coupling capacitance. In this treatment, the coupling capacitance obtained depends on the opposing area as well as a distance between the opposing electrodes. Therefore, when the trimmed area (the area to be removed) increases along an axial direction of the through hole, the coupling capacitance proportionally changes. Thus, the amount of change in the coupling capacitance changes in proportion to the trimmed amount in the axial direction of the through hole. However, when the trimmed area (the area to be removed) increases along a circumferential direction of the through hole, less contribution to the change in the coupling capacitance, i.e., to the change in the bandwidth is realized.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A dielectric filter, comprising:

a molded member of a pillar shape which is made of a dielectric material and has a hole formed from a first end surface thereof toward the inside;

an inner electrode formed so as to cover the inner circumferential surface of said hole and having a predetermined area;

an outer electrode provided so as to cover a portion of the outer surface of said molded member except a prescribed region; and a coupling electrode provided only on a side face of the molded member;

wherein a coupling capacitance which is formed between said inner electrode and said coupling electrode is adjusted by adjusting the predetermined area of the inner electrode without changing a distance from the side face of the molded member to the hole formed in the molded member; and said first end surface of said molded member is included in said prescribed region, thereby forming an open end, and one edge of said coupling electrode is level with at least said open end of said molded member.

2. A dielectric filter according to claim 1, wherein said hole penetrates from said first end surface to a second end surface.

3. A dielectric filter according to claim 1, wherein said dielectric filter further comprises another coupling electrode, and said coupling electrodes are respectively provided on different side surfaces of said molded member.

4. A dielectric filter including a plurality of dielectric filter components, each of the plurality of said dielectric filter components comprising:

a molded member of a pillar shape which is made of a dielectric material and has a hole formed from a first end surface thereof toward the inside;

an inner electrode formed so as to cover the inner circumferential surface of said hole and having a predetermined area;

an outer electrode provided so as to cover a portion of the outer surface of said molded member except a prescribed region, and a coupling electrode provided only on a side face of the molded member;

wherein said coupling electrodes of said plurality of dielectric filter components are electrically connected with each other;

in at least one of the plurality of said dielectric filter components, a coupling capacitance which is formed between said inner electrode and said coupling electrode is adjusted by adjusting the predetermined area of the inner electrode without changing a distance from the side face of the molded member to the hole formed in the molded member; and said first end surface of said molded member is included in said prescribed region, thereby forming an open end, and in at least one of the plurality of said dielectric filter components, one edge of said coupling electrode is level with at least said open end of said molded member.

5. A dielectric filter according to claim 4, wherein in said at least one of the plurality of said dielectric filter components, said hole penetrates from said first end surface to a second end surface.

6. A dielectric filter according to claim 4, wherein said at least one of the plurality of said dielectric filter components further includes another coupling electrode and, said coupling electrodes are respectively provided on different side surfaces of said molded member.

7. A dielectric filter, comprising:

a molded member of a pillar shape which is made of a dielectric material and has a hole formed from a first end surface thereof toward the inside;

an inner electrode formed so as to cover a portion of the inner circumferential surface of said hole except a selected region;

an outer electrode provided so as to cover a portion of the outer surface of said molded member except a prescribed region; and a coupling electrode provided on only a side face of said molded member;

wherein a coupling capacitance which is formed between said inner electrode and said coupling electrode is adjusted by adjusting said selected region such that an area of said inner electrode is changed without changing a distance from the side face of said molded member to the hole formed in said molded member; and said first end surface of said molded member is included in said prescribed region, thereby forming an open end, and one edge of said coupling electrode is level with at least said open end of said molded member.

8. A dielectric filter according to claim 7, wherein said hole penetrates from said first end surface to a second end surface.

9. A dielectric filter according to claim 7, wherein said dielectric filter further comprises another coupling electrode, and said coupling electrodes are respectively provided on different side surfaces of said molded member.

10. A dielectric filter including a plurality of dielectric filter components, each of the plurality of said dielectric filter components comprising:

a molded member of a pillar shape which is made of a dielectric material and has a hole formed from a first end surface thereof toward the inside;

an inner electrode formed so as to cover a portion of the inner circumferential surface of said hole except a selected region;

an outer electrode provided so as to cover a portion of the outer surface of said molded member except a prescribed region; and a coupling electrode provided on only a side face of said molded member;

wherein said coupling electrodes of said plurality of dielectric filter components are electrically connected with each other;

in at least one of the plurality of said dielectric filter components, a coupling capacitance which is formed between said inner electrode and said coupling electrode is adjusted by adjusting said selected region such that an area of said inner electrode is changed without changing a distance from the side face of said molded member to the hole formed in said molded member; and said first end surface of said molded member is included in said prescribed region, thereby forming an open end, and, in at least one of the plurality of said dielectric filter components, one edge of said coupling electrode is level with at least said open end of said molded member.

11. A dielectric filter according to claim 10, wherein in said at least one of the plurality of said dielectric filter components, said hole penetrates from said first end surface to a second end surface.

12. A dielectric filter according to claim 10, wherein said at least one of the plurality of said dielectric filter components further includes another coupling electrode and, said coupling electrodes are respectively provided on different side surfaces of said molded member.

13. A method of adjusting a bandwidth of a dielectric filter, wherein said dielectric filter is made of a dielectric material and comprises a molded member of a pillar shape which has a hole formed from a first end surface thereof toward the inside, an inner electrode formed so as to cover the inner circumferential surface of said hole and having a predetermined area, an outer electrode provided so as to cover the outer surface of said molded member except a prescribed region; and a coupling electrode provided on only a side face of said molded member; said method comprising the step of:

adjusting a coupling capacitance which is formed between said inner electrode and said coupling electrode by adjusting the predetermined area of said inner electrode without changing a distance from the side face of said molded member to the hole formed in said molded member, wherein the adjustment of the area of said inner electrode includes trimming a selected region of said inner electrode;

wherein said first end surface of said molded member is included in said prescribed region, thereby forming an open end, and one edge of said coupling electrode is level with at least said open end of said molded member.

14. An adjusting method according to claim 13, wherein said hole penetrates from said first end surface to a second end surface.

15. An adjusting method according to claim 13, wherein said dielectric filter further comprises another coupling electrode, and said coupling electrodes are respectively provided on different side surfaces of said molded member.

16. A method of adjusting a bandwidth of a dielectric filter including a plurality of dielectric filter components, wherein each of the plurality of said dielectric filter components comprises a molded member which is made of a dielectric material and has a hole formed from a first end surface thereof toward the inside, an inner electrode formed so as to cover the inner circumferential surface of said hole and having a predetermined area, an outer electrode provided so as to cover a portion of the outer surface of said molded member except a prescribed region, and a coupling electrode provided on only a side face of said molded member, and said coupling electrodes of the plurality of said dielectric filter components are electrically connected with each other; said method comprising the step of:

in at least one of the plurality of said dielectric filter components, adjusting a coupling capacitance which is formed between said inner electrode and said coupling electrode by adjusting the predetermined area of said inner electrode without changing a distance from the side face of said molded member to the hole formed in said molded member, wherein said first end surface of said molded member is included in said prescribed region, thereby forming an open end, and, in at least one of the plurality of said dielectric filter components, one edge of said coupling electrode is level with at least said open end of said molded member.

17. An adjusting method according to claim 16, wherein in said at least one of the plurality of said dielectric filter components, said hole penetrates from said first end surface to a second end surface.

18. An adjusting method according to claim 16, wherein said at least one of the plurality of said dielectric filter components further includes another coupling electrode and, said coupling electrodes are respectively provided on different side surfaces of said molded member.

* * * * *